US009719519B2

(12) United States Patent
Noonan et al.

(10) Patent No.: US 9,719,519 B2
(45) Date of Patent: Aug. 1, 2017

(54) DROPPED CEILING FAN

(71) Applicant: Thomas F. Noonan, Indianapolis, IN (US)

(72) Inventors: Thomas F. Noonan, Indianapolis, IN (US); Kirt T. Gardner, Indianapolis, IN (US)

(73) Assignee: Thomas F. Noonan, Indianapolis, IN (US)

( * ) Notice: Subject to any disclaimer, the term of this patent is extended or adjusted under 35 U.S.C. 154(b) by 562 days.

(21) Appl. No.: 14/215,326

(22) Filed: Mar. 17, 2014

(65) Prior Publication Data

US 2014/0271211 A1 Sep. 18, 2014

Related U.S. Application Data

(60) Provisional application No. 61/798,501, filed on Mar. 15, 2013.

(51) Int. Cl.

| | |
|---|---|
| ***F04D 19/00*** | (2006.01) |
| ***F04D 25/08*** | (2006.01) |
| ***F04D 29/52*** | (2006.01) |
| ***F24F 7/007*** | (2006.01) |
| *F24F 1/00* | (2011.01) |

(52) U.S. Cl.

CPC ..... *F04D 25/088* (2013.01); *F04D 29/522* (2013.01); *F24F 7/007* (2013.01); *F24F 2001/0037* (2013.01); *F24F 2001/0062* (2013.01); *F24F 2001/0096* (2013.01)

(58) Field of Classification Search

CPC ..... F24F 2013/0616; F24F 13/06; F24F 2221/14; F24F 7/10; F24F 7/013; F24F 13/068; F24F 7/06; F24F 2007/001; E04B 9/02; F04D 25/088; F04D 25/12; E03D 9/052; E03D 9/04

USPC ..... 454/248, 292, 354, 243, 234; 415/213.1

See application file for complete search history.

(56) References Cited

U.S. PATENT DOCUMENTS

| | | | | |
|---|---|---|---|---|
| 2,245,470 | A | 6/1941 | Fuchs | |
| 4,062,400 | A | 12/1977 | Horowitz | |
| 4,730,551 | A * | 3/1988 | Peludat | F24F 3/1603 454/233 |
| 5,053,065 | A | 10/1991 | Garay et al. | |
| 5,099,587 | A | 3/1992 | Jarosch | |
| 5,167,681 | A | 12/1992 | O'Keefe et al. | |

(Continued)

*Primary Examiner* — Steven B McAllister
*Assistant Examiner* — Ko-Wei Lin
(74) *Attorney, Agent, or Firm* — Woodard, Emhardt, Moriarty, McNett & Henry LLP

(57) ABSTRACT

Disclosed is a dropped ceiling fan that includes an elongated body with a fan inside the elongated body that move air downward in the elongated body with a plate positioned below the fan with a hole in the airflow of the fan, a peripheral intake that surrounds the plate and several inclined elements that direct air that is adjacent to the elongated body into the peripheral intake. The elongated body includes a hole in the top that, in combination with the peripheral intake, defines the intake for the fan, to take inlet air from either the room below or both the room below and the space above the dropped ceiling. Also disclosed is a mounting bracket to permit HVAC ducting to be coupled to the hole on top of the body to permit the fan to be used as a powered register with an HVAC system.

17 Claims, 14 Drawing Sheets

(56) References Cited

U.S. PATENT DOCUMENTS

| | | | | |
|---|---|---|---|---|
| 5,452,710 | A | 9/1995 | Palmer | |
| 6,471,582 | B1 * | 10/2002 | Tucker | F24F 3/161 454/187 |
| 7,468,084 | B2 | 12/2008 | Bauer et al. | |
| 2007/0243819 | A1 * | 10/2007 | Ladanyi | F04D 25/088 454/354 |
| 2009/0092488 | A1 * | 4/2009 | Weaver | F04D 25/12 415/211.2 |
| 2010/0303617 | A1 * | 12/2010 | Chen | F04D 25/088 415/208.2 |

* cited by examiner

DROPPED CEILING FAN

CROSS REFERENCE TO RELATED APPLICATIONS

The present application claims the benefit of U.S. Provisional Patent Application, Ser. No. 61/798,501 filed Mar. 15, 2013, which is hereby incorporated by reference.

BACKGROUND

This disclosure relates to dropped ceiling fans.

Fan housing units are used in various industries to distribute, circulate, or divert fluids, such as air, propelled by a fluid impelling device. One example where fan housings are used is in the heating and cooling industry. Fan housings typically direct or circulate the flow of hot or cold air into particular rooms or areas within a building or structure. Fan housings may be coupled to a duct or a fluid impelling device. The duct may carry the air from a heating or cooling unit to an opening of the fan housing. The shape and design of the fan housing unit may either disperse the air current over a wide area or redirect the air current to another duct or fan housing unit.

One purpose of current fan housing units is to circulate air to heat or cool an area quickly and efficiently. As a result, the shape and design of current fan housing units typically do not direct the air to a centralized or focused location. To direct the air to a localized area, instead of dispersing the air over a wide area, will result in the room or area to have a substantial temperature gradient. Moreover, more air and energy would be required before the room temperature is substantially uniform. To overcome some temperature gradient situations, ceiling fans may be employed, generally without any housing unit, to further disperse and mix the air over a wide area within a room. The term "ceiling fan" is used in this document in the conventional sense to refer to a fan not connected with the ducting of any central HVAC system and adapted to be situated to move air substantially vertically within an area.

In a commercial setting, such as a department store or warehouse, the requirements may be different. For example, a commercial or industrial structure may have higher ceilings than a residential unit. Moreover, commercial settings may also include aisles or display units comprising products or goods with rows therebetween. In such a setting, dispersing the air over a wide area may not effectively circulate, heat, or cool the areas between the display units. Accordingly, one problem with conventional ceiling fans is that they do not direct the air to a focused location within a room, but rather tend to disperse the air over a wide area. Conventional ceiling fans are not designed to produce a sufficient column of air that will remain focused on a localized area as the air approaches the ground level.

DETAILED DESCRIPTION

Figure 1:
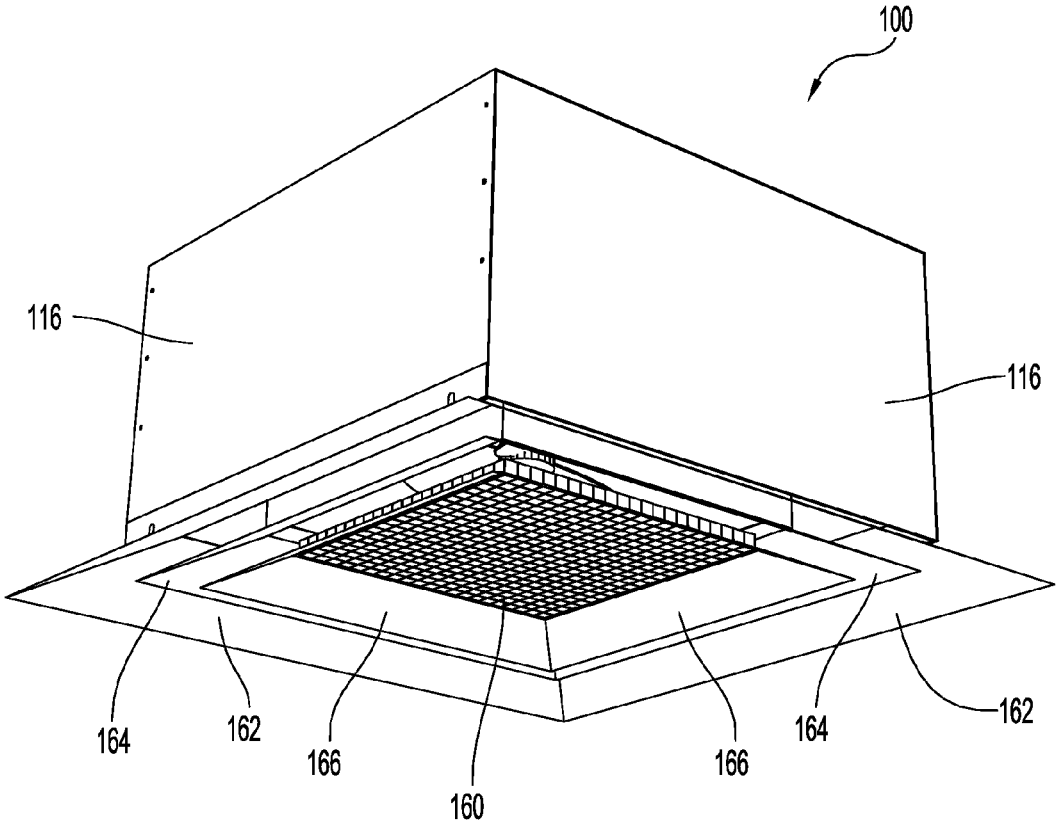
FIG. 1 illustrates a bottom perspective view of a dropped ceiling fan.
Figure 2:
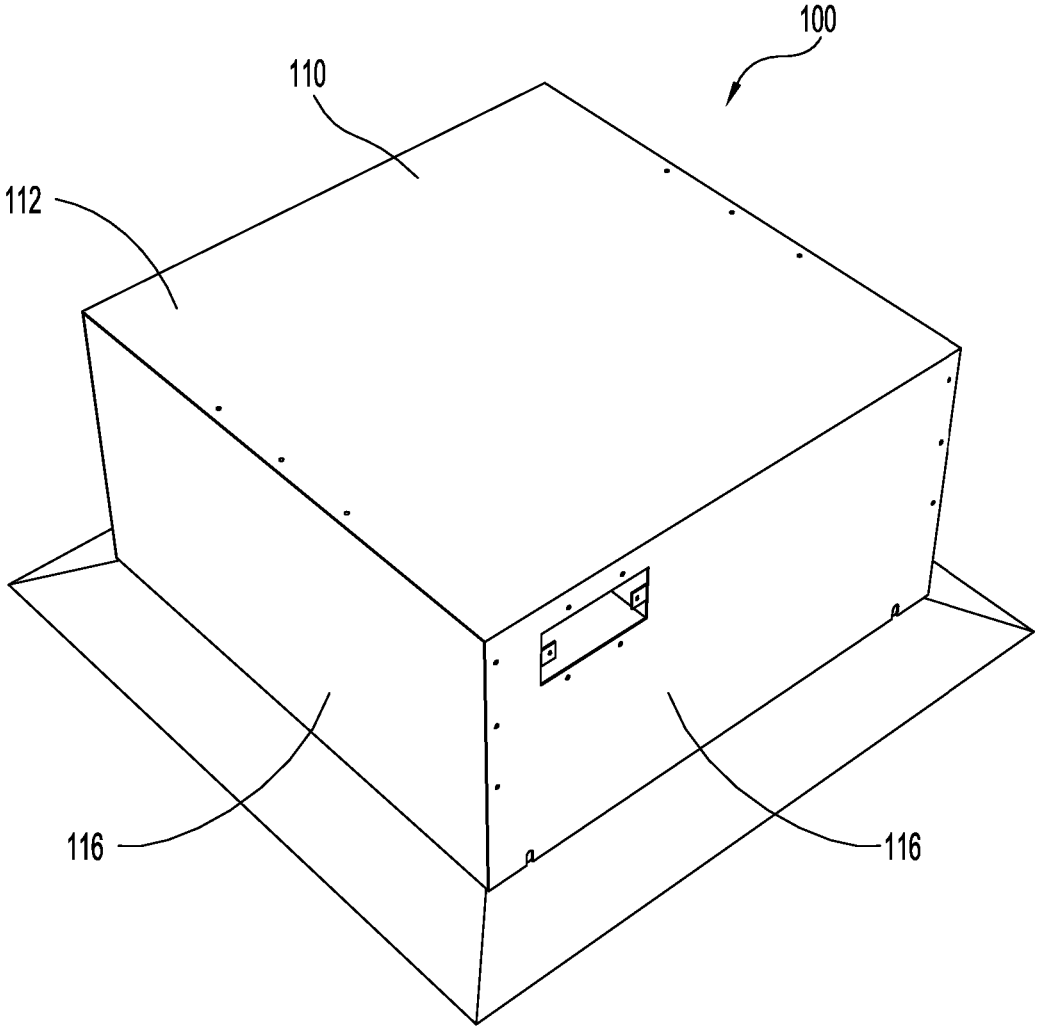
FIG. 2 illustrates a top perspective view of the FIG. 1 dropped ceiling fan.
Figure 3:
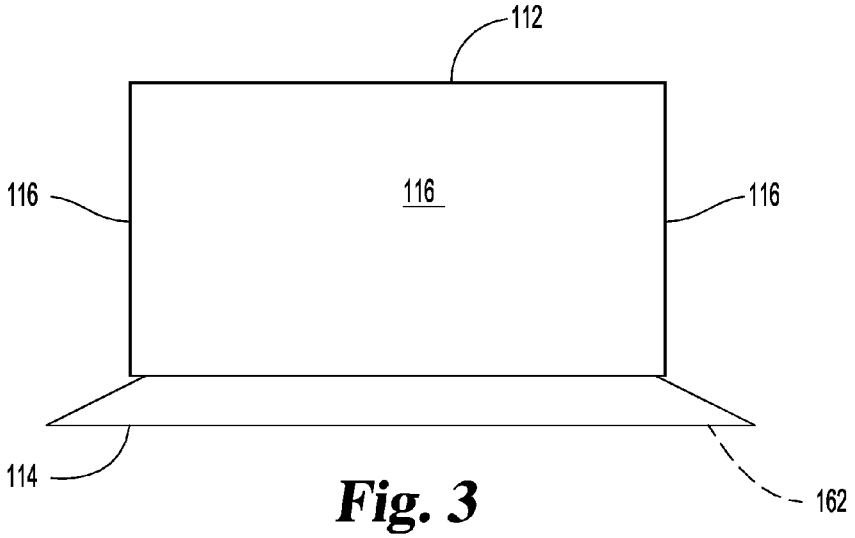
FIG. 3 illustrates a front elevational view of the FIG. 1 dropped ceiling fan.
Figure 4:
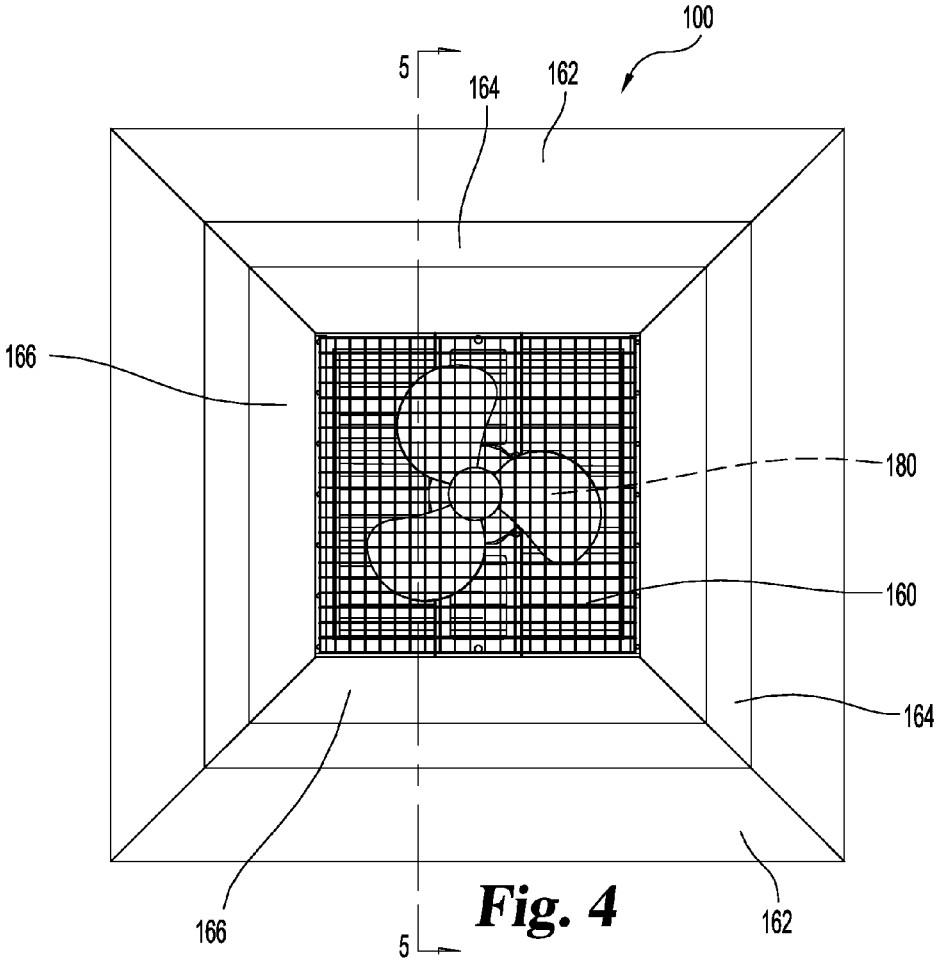
FIG. 4 illustrates a bottom plan view of the FIG. 1 dropped ceiling fan.

Reference will now be made to certain embodiments and specific language will be used to describe the same. It should be understood that no limitation of the scope of this disclosure and the claims are thereby intended, such alterations, further modifications and further applications of the principles described herein being contemplated as would normally occur to one skilled in the art to which this disclosure relates. In several figures, where there are the same or similar elements, those elements are designated with the same or similar reference numerals.

The disclosed embodiments relate to modular ceiling fan housing units 100, 200, 300 and 400 described below.

Referring to FIGS. 1-5, dropped ceiling fan 100 is illustrated. Dropped ceiling fan 100 includes outer body element 110, inner body element 140 and fluid impelling device 180. Outer body element 110 includes top surface 112, bottom 114 and four side surfaces 116. In the illustrated embodiment, top surface 112 and side surfaces 116 are substantially fluid impenetrable and together define cavity 118. Bottom 114 defines opening 120.

Inner body element 140 includes top surface 142, bottom 144 and four side surfaces 146. The four side surfaces 146 are substantially fluid impenetrable and together define cavity 148. Top surface 142 includes opening 150 and bottom 144 defines opening 152.

In general, dropped ceiling fan 100 is constructed and arranged to be suspended in a dropped ceiling replacing a ceiling tile with dropped ceiling fan 100 between ceiling tile supports. In this regard, outer body element 112 may include various attachment points to suspend dropped ceiling fan 100 from a ceiling and/or to mount dropped ceiling fan 100 on a suspended tile support rail system (not illustrated).

Fluid impelling device 180 is mounted within cavity 148 of inner body element 140 and is arranged to move air downward from top surface 142 towards bottom 144 and opening 152.

Figure 5:
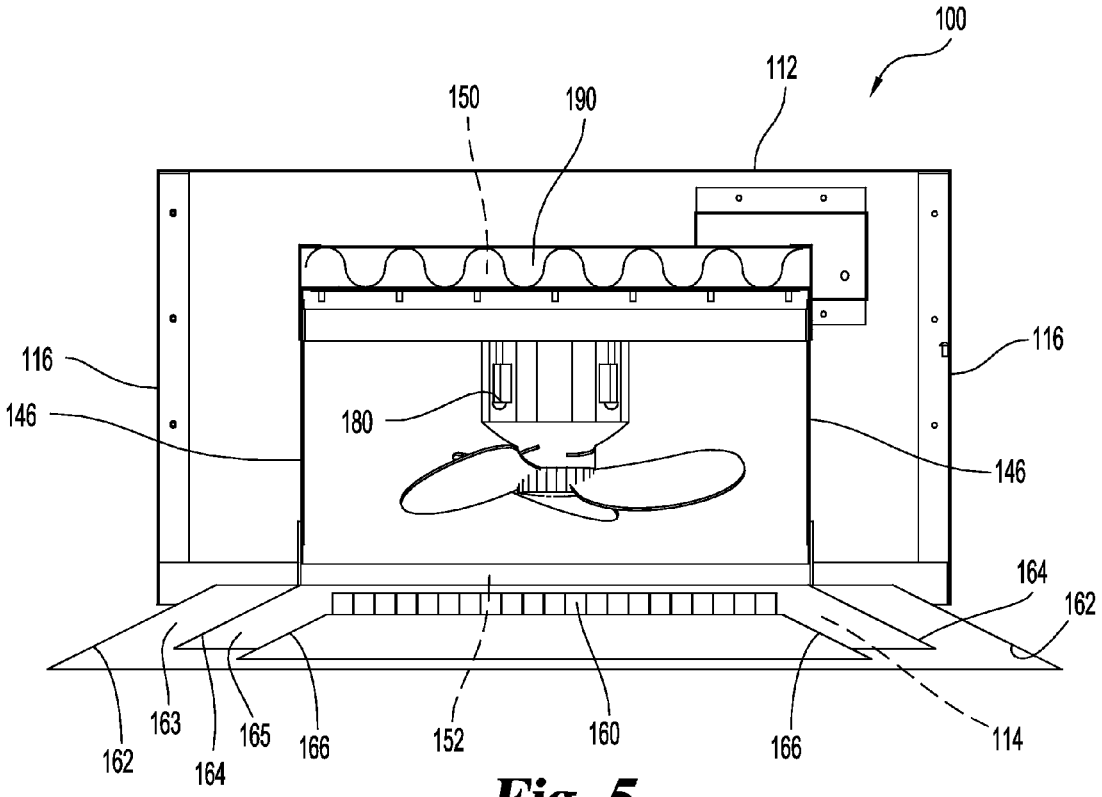
FIG. 5 illustrates a cross-sectional view of the FIG. 1 dropped ceiling fan taken along line 5-5 in FIG. 4.
Figure 6:
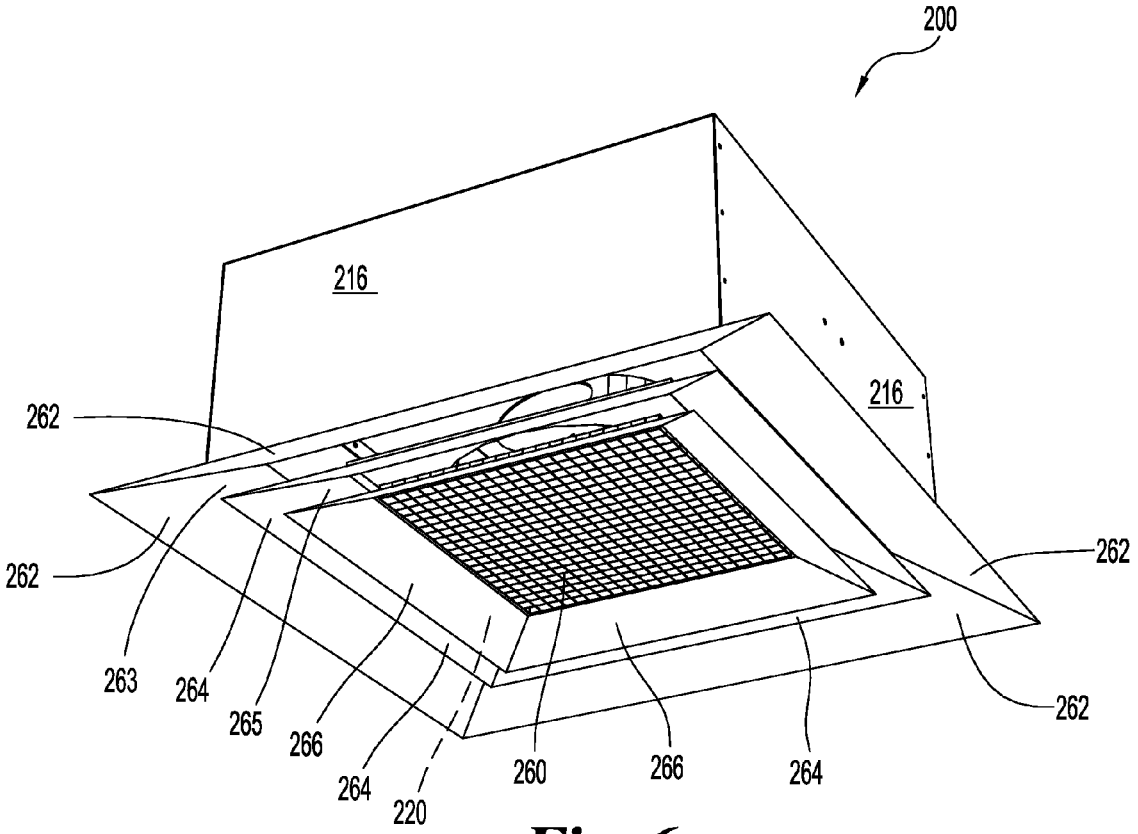
FIG. 6 illustrates a bottom perspective view of an alternative embodiment of a dropped ceiling fan.
Figure 7:
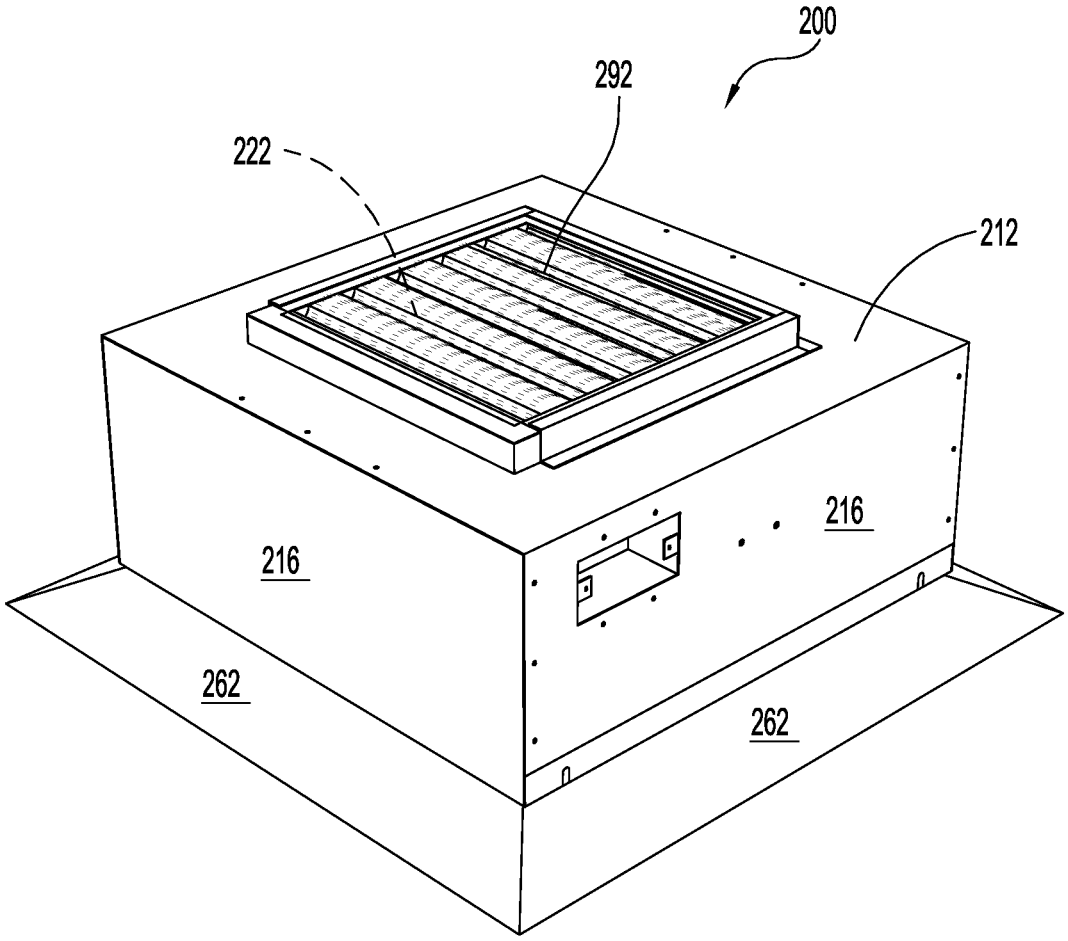
FIG. 7 illustrates a top perspective view of the FIG. 6 dropped ceiling fan.
Figure 8:
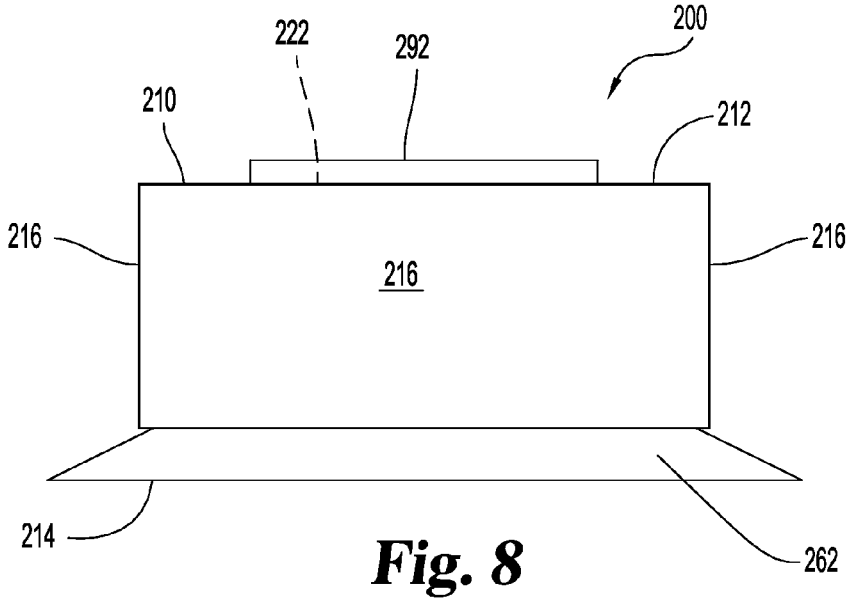
FIG. 8 illustrates a front elevational view of the FIG. 6 dropped ceiling fan.
Figure 9:
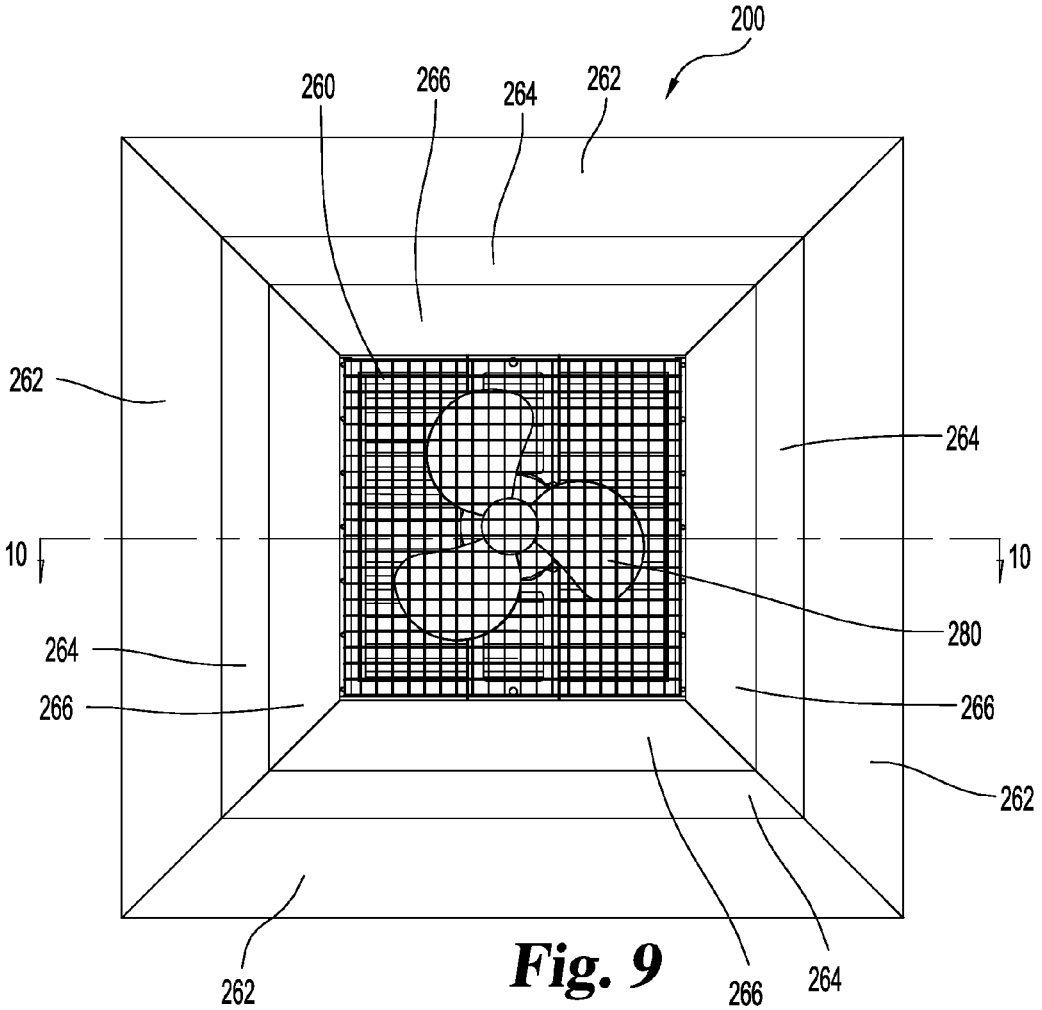
FIG. 9 illustrates a bottom plan view of the FIG. 6 dropped ceiling fan.

As best seen in FIG. 5, inner body element 140 includes filter 190 mounted across top surface 142. Filter 190 is mounted in such a way that substantially all the air passing through opening 152 passes through the filter 190.

Dropped ceiling fan 100 also includes grid element 160, inclined elements 162, inclined elements 164 and inclined elements 166. As best seen in FIG. 5, inner body element 140 is positioned near the center of cavity 118 of outer body element 110. Inclined elements 162 extend downwardly and outwardly from the periphery of sides 116 defining outer body element 110. Inclined elements 164 extend downwardly and outwardly from sides 146 defining the periphery of inner body element 140. Grid 160 is supported in the middle of opening 152 with inclined elements 166 extending downwardly and outwardly from the periphery of grid 160. Inclined elements 162 and 164 cooperate to define inlet 163 that is constructed and arranged to collect air from the periphery area of the dropped ceiling fan near the ceiling. Inclined elements 164 and 166 cooperate to define outlet 165 that is constructed and arranged to direct expelled air outwardly and downwardly from dropped ceiling fan 100. Grid 160 comprises a plurality of vertically oriented elements positioned in opening 152 and constructed and arranged to direct expelled air downwardly from dropped ceiling fan 100.

Filter 190 may be rated MERF 14 which is sufficient for nonsurgical rooms in a hospital and may be used to maintain air quality in such an environment.

Referring to FIGS. 6-10, dropped ceiling fan 200 is illustrated. Dropped ceiling fan 200 includes outer body element 210 and fluid impelling device 280. Outer body element 210 includes top surface 212, bottom 214 and four side surfaces 216. In the illustrated embodiment, side surfaces 216 are substantially fluid impenetrable and together define cavity 218. Bottom 214 defines opening 220.

In general, dropped ceiling fan 200 is constructed and arranged to be suspended in a dropped ceiling replacing a ceiling tile with dropped ceiling fan 200 between ceiling tile supports. In this regard, outer body element 212 may include various attachment points to suspend dropped ceiling fan 200 from a ceiling and/or to mount dropped ceiling fan 200 on a suspended tile support rail system (not illustrated).

Fluid impelling device 280 is mounted within cavity 218 of outer body element 210 and is arranged to move air downward from top surface 212 towards bottom 214 and opening 220.

Figure 10:
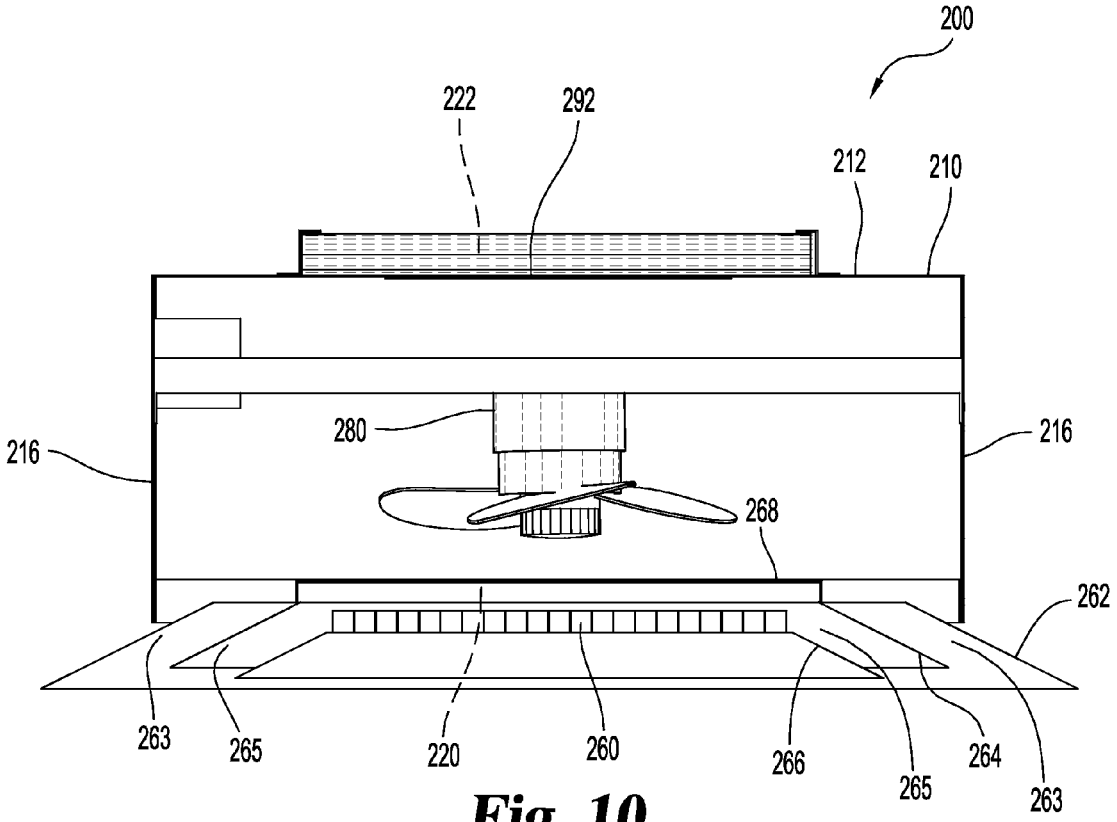
FIG. 10 illustrates a cross-sectional view of the FIG. 6 dropped ceiling fan taken along line 10-10 in FIG. 9.

As best seen in FIG. 10, outer body element 210 includes filter 292 mounted across top surface 212. Filter 292 is mounted in such a way that substantially all the air passing through opening 222 passes through filter 292.

Dropped ceiling fan 200 also includes grid element 260, inclined elements 262, inclined elements 264 and inclined elements 266. Inclined elements 262 extend downwardly and outwardly from the periphery of sides 216 defining outer body element 210. Inclined elements 164 extend downwardly and outwardly from plate 268 that extends around the periphery of opening 220 above grid 260. Grid 160 is supported in the middle of opening 220 with inclined elements 166 extending downwardly and outwardly from the periphery of grid 260. Inclined elements 262 and 264 cooperate to define inlet 263 that is constructed and arranged to collect air from the periphery area of the dropped ceiling fan near the ceiling. Inclined elements 264 and 266 cooperate to define outlet 265 that is constructed and arranged to direct expelled air outwardly and downwardly from dropped ceiling fan 200. Grid 260 comprises a plurality of vertically oriented elements positioned in opening 252 and constructed and arranged to direct expelled air downwardly from dropped ceiling fan 200.

Dropped ceiling fan 200 is configured to draw air from the room below through inlet 263 as well as draw air from above the ceiling through opening 222 and filter 292 and expel the air into the room below through grid 260 and outlet 265 when fluid impelling device 280 operates. In one embodiment, dropped ceiling fan 200 draws approximately half the inlet air from the room below and the other half from the space above the dropped ceiling.

Filter 292 may be rated MERF 14 which is sufficient for nonsurgical rooms in a hospital and may be used to maintain air quality in such an environment.

Figure 11:
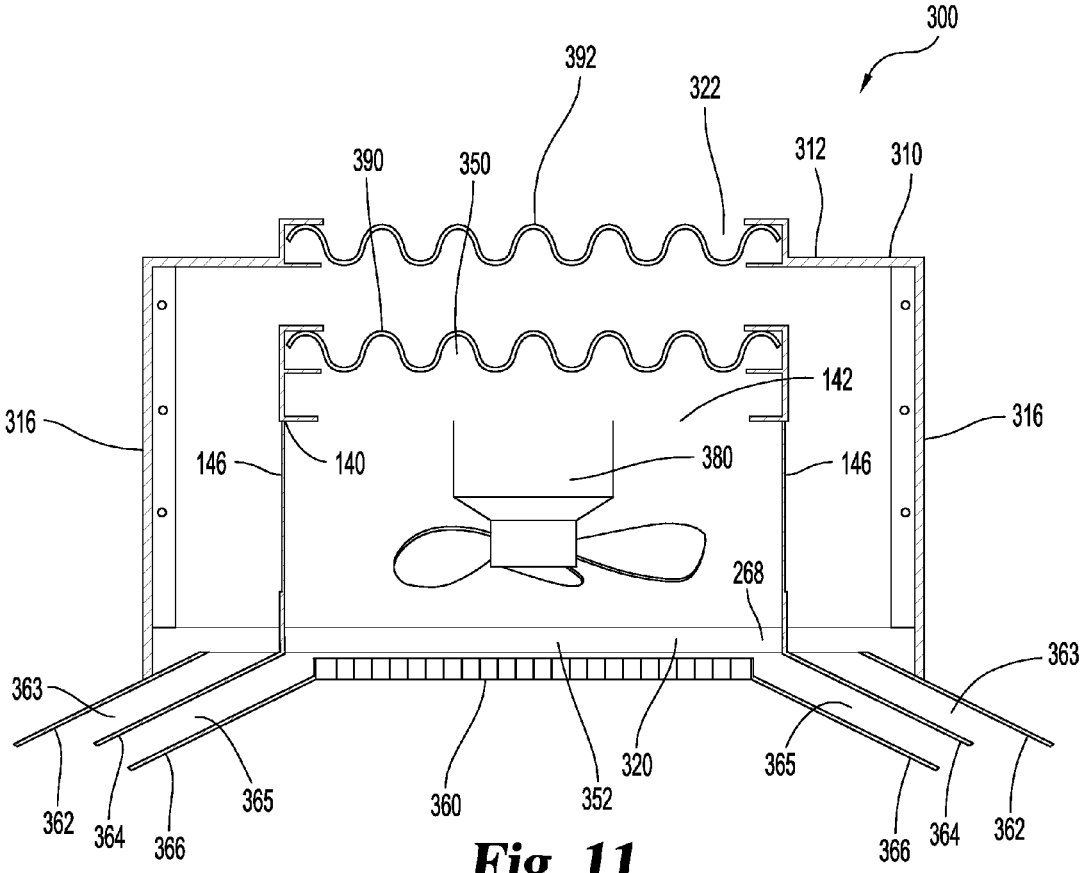
FIG. 11 illustrates a cross-sectional side elevational view of a third embodiment of a dropped ceiling fan.

Referring to FIG. 11, dropped ceiling fan 300 is illustrated. Dropped ceiling fan 100 includes outer body element 310, inner body element 340 and fluid impelling device 180. Outer body element 310 includes top surface 312, bottom 314 and four side surfaces 116. In the illustrated embodiment, side surfaces 316 are substantially fluid impenetrable and together define cavity 318. Bottom 314 defines opening 320. Top surface 312 defines opening 322.

Inner body element 340 includes top surface 342, bottom 344 and four side surfaces 346. The four side surfaces 346 are substantially fluid impenetrable and together define cavity 348. Top surface 342 defines opening 350 and bottom 344 defines opening 352

In general, dropped ceiling fan 300 is constructed and arranged to be suspended in a dropped ceiling replacing a tile with dropped ceiling fan 300. In this regard, outer body element 312 may include various attachment points to suspend dropped ceiling fan 300 from a ceiling and/or to mount dropped ceiling fan 300 on a suspended rail system (not illustrated).

Fluid impelling device 380 is located within cavity 348 of inner body element 340 and is arranged to move air downward from top surface 342 towards bottom 344 and opening 352.

Outer body element 310 includes filter 392 mounted across top surface 312. Filter 392 is mounted in such a way that substantially all the air passing through opening 322 passes through filter 392. Inner body element 340 includes filter 390 mounted across top surface 342. Filter 390 is mounted in such a way that substantially all the air passing through opening 352 passes through the filter 390.

Dropped ceiling fan 300 also includes grid element 360, inclined elements 362, inclined elements 364 and inclined elements 366. Inner body element 340 is positioned in the center of cavity 318 in outer body element 310. Inclined elements 362 extend from the periphery of sides 316 defining outer body element 310. Inclined elements 364 extend outwardly from sides 364 defining the periphery of inner body element 340. Grid 360 is supported in the middle of opening 352 with inclined elements 366 extending outwardly from the periphery of grid 360. Inclined elements 362 and 364 cooperate to define inlet 363 that is constructed and arranged to collect air from the periphery area of the dropped ceiling fan near the ceiling. Inclined elements 364 and 366 cooperate to define outlet 365 that is constructed and arranged to direct expelled air outwardly and downwardly from dropped ceiling fan 300. Grid 360 comprises a plurality of vertically oriented elements positioned in opening 352 and is constructed and arranged to direct expelled air downwardly from dropped ceiling fan 300.

Dropped ceiling fan 300 is configured to draw air from the room below through inlet 363 as well as draw air from above the dropped ceiling through opening 322 and filter 392 and expel the air into the room below through grid 360 and outlet 365 when fluid impelling device 380 operates. In one embodiment, dropped ceiling fan 300 draws approximately half the inlet air from the room below and the other half from the space above the dropped ceiling.

Filters 390 and 392 may be rated MERF 14 which is sufficient for nonsurgical rooms in a hospital and may be used to maintain air quality in such an environment.

Figure 12:
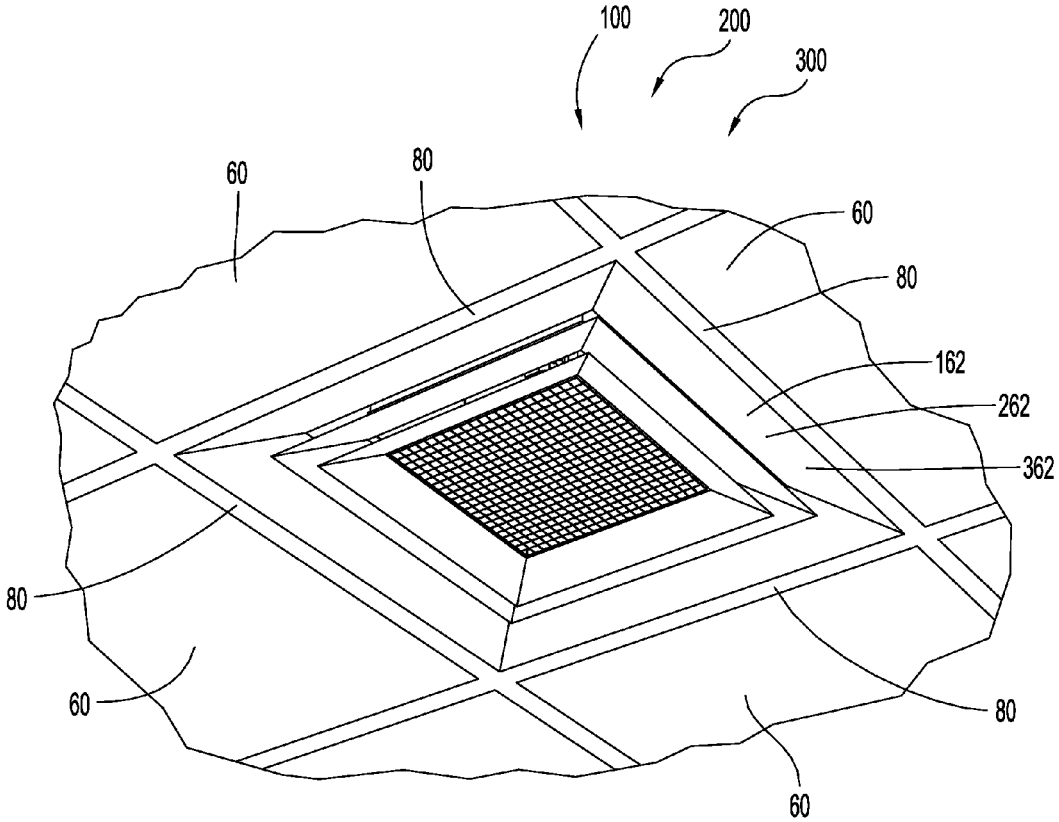
FIG. 12 illustrates the dropped ceiling fan of FIG. 1, 6 or 11 installed in a ceiling.
Figure 13:
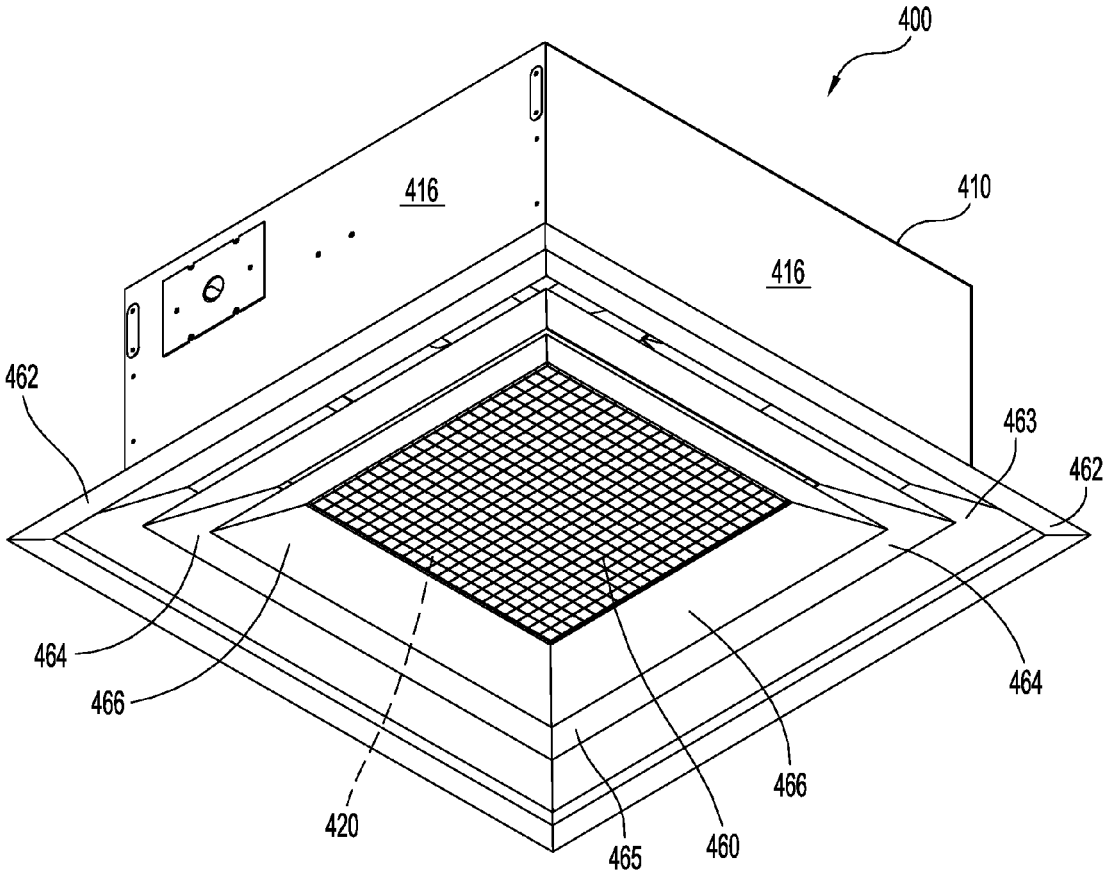
FIG. 13 illustrates a bottom perspective view of yet another alternative embodiment of a dropped ceiling fan.

Referring to FIG. 12, a representative dropped ceiling fan 100, 200 or 300 is shown installed in a dropped ceiling. Specifically, dropped ceiling fan 100, 200 or 300 is suspended with the outer periphery of dropped ceiling fan 100, 200 or 300 defined by inclined elements 162, 262 or 362 positioned near dropped rails 80 with ceiling tiles 60 positioned on the opposite sides of dropped rails 80.

Referring to FIGS. 6-10, dropped ceiling fan 200 is illustrated. Dropped ceiling fan 200 includes outer body element 210 and fluid impelling device 280. Outer body element 210 includes top surface 212, bottom 214 and four side surfaces 216. In the illustrated embodiment, side surfaces 216 are substantially fluid impenetrable and together define cavity 218. Bottom 214 defines opening 220.

In general, dropped ceiling fan 200 is constructed and arranged to be suspended in a dropped ceiling replacing a ceiling tile with dropped ceiling fan 200 between ceiling tile supports. In this regard, outer body element 212 may include various attachment points to suspend dropped ceiling fan 200 from a ceiling and/or to mount dropped ceiling fan 200 on a suspended tile support rail system (not illustrated).

Fluid impelling device 280 is mounted within cavity 218 of outer body element 210 and is arranged to move air downward from top surface 212 towards bottom 214 and opening 220.

As best seen in FIG. 10, outer body element 210 includes filter 292 mounted across top surface 212. Filter 292 is mounted in such a way that substantially all the air passing through opening 222 passes through filter 292.

Dropped ceiling fan 200 also includes grid element 260, inclined elements 262, inclined elements 264 and inclined elements 266. Inclined elements 262 extend downwardly and outwardly from the periphery of sides 216 defining outer body element 210. Inclined elements 164 extend downwardly and outwardly from plate 268 that extends around the periphery of opening 220 above grid 260. Grid 160 is supported in the middle of opening 220 with inclined elements 166 extending downwardly and outwardly from the periphery of grid 260. Inclined elements 262 and 264 cooperate to define inlet 263 that is constructed and arranged to collect air from the periphery area of the dropped ceiling fan near the ceiling. Inclined elements 264 and 266 cooperate to define outlet 265 that is constructed and arranged to direct expelled air outwardly and downwardly from dropped ceiling fan 200. Grid 260 comprises a plurality of vertically oriented elements positioned in opening 252 and constructed and arranged to direct expelled air downwardly from dropped ceiling fan 200.

Dropped ceiling fan 200 is configured to draw air from the room below through inlet 263 as well as draw air from above the ceiling through opening 222 and filter 292 and expel the air into the room below through grid 260 and outlet 265 when fluid impelling device 280 operates. In one embodiment, dropped ceiling fan 200 draws approximately half the inlet air from the room below and the other half from the space above the dropped ceiling.

Referring to FIGS. 13-17, dropped ceiling fan 400 is illustrated. Dropped ceiling fan 400 includes outer body element 210 and fluid impelling device 480. Outer body element 410 includes top surface 412, bottom 414 and four side surfaces 416. In the illustrated embodiment, side surfaces 416 are substantially fluid impenetrable and together define cavity 418. Bottom 414 includes several opening as described below.

In general, dropped ceiling fan 400 is constructed and arranged to be suspended in a dropped ceiling replacing a ceiling tile with dropped ceiling fan 400 between ceiling tile supports. In this regard, outer body element 412 may include various attachment points to suspend dropped ceiling fan 400 from a ceiling and/or to mount dropped ceiling fan 400 on a suspended tile support rail system (not illustrated).

Fluid impelling device 480 is mounted within cavity 418 of outer body element 410 and is arranged to move air downward from top surface 412 towards bottom 414 and opening 420. Fluid impelling device 480 is generally aligned with the vertical axis defined by outer body element 410. Opening 420 is generally aligned with both body element 410 and fluid impelling device 480.

Figure 14:
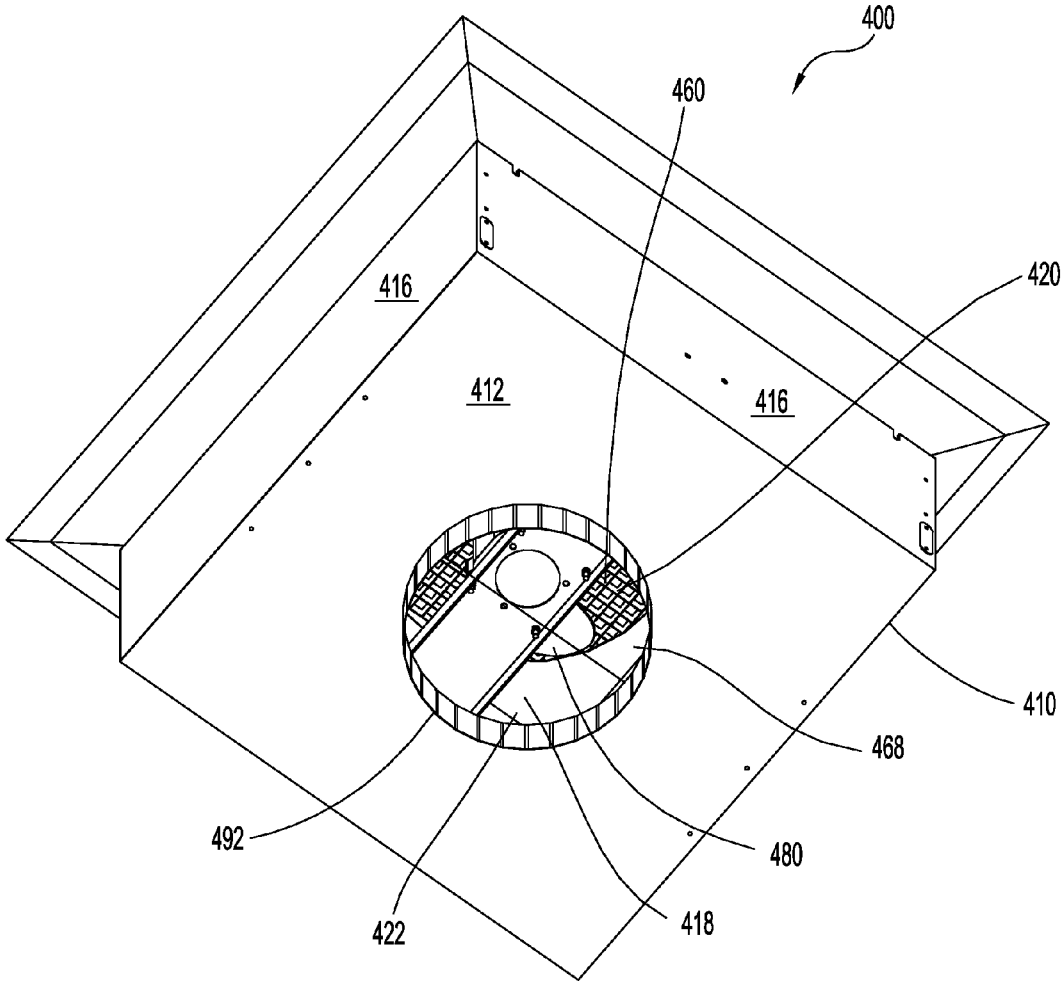
FIG. 14 illustrates a top perspective view of the FIG. 13 dropped ceiling fan.
Figure 15:
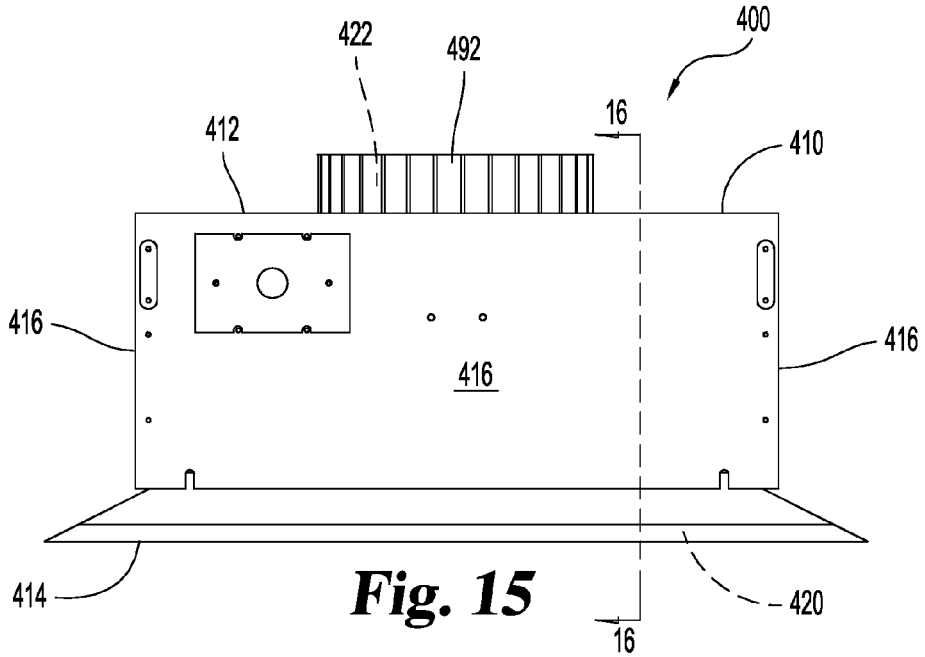
FIG. 15 illustrates a side view of the FIG. 13 dropped ceiling fan.
Figure 16:
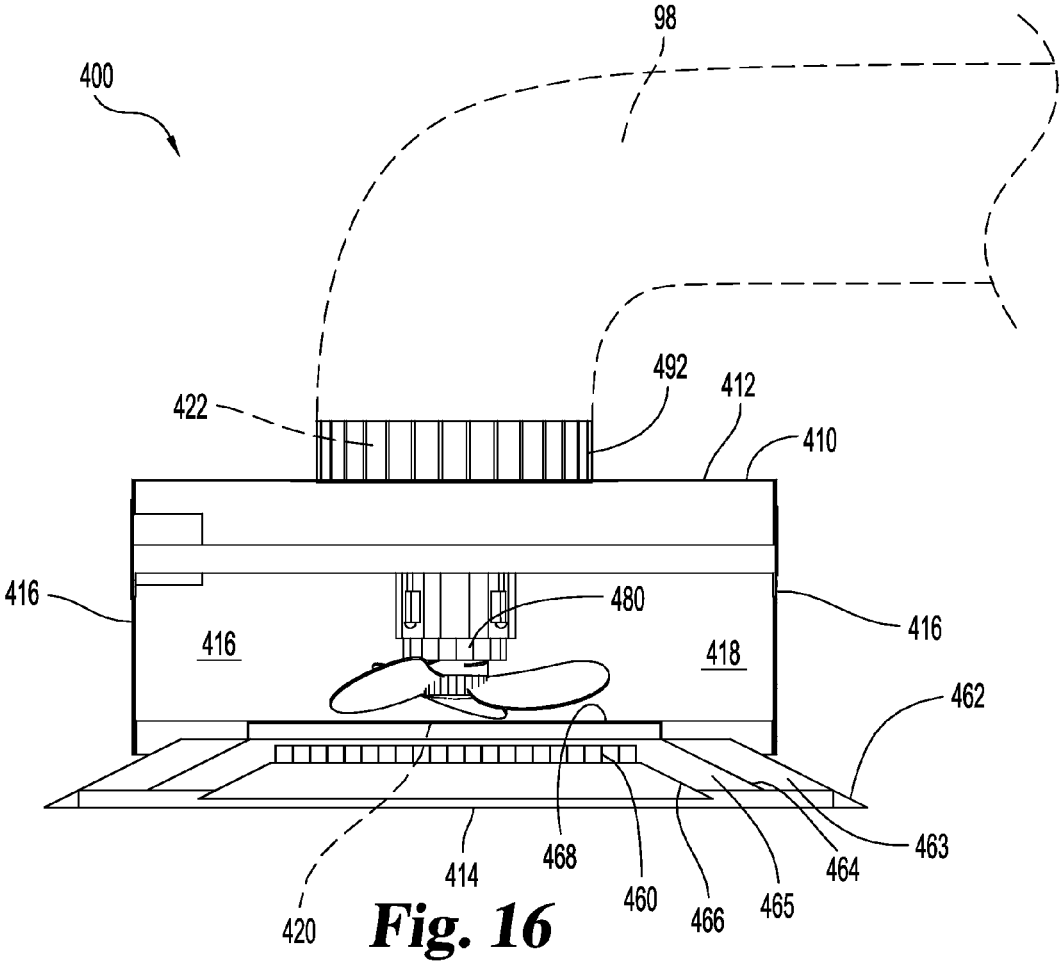
FIG. 16 illustrates a side cross-sectional view of the FIG. 13 dropped ceiling fan taken along line 16-16 in FIG. 15.
Figure 17:
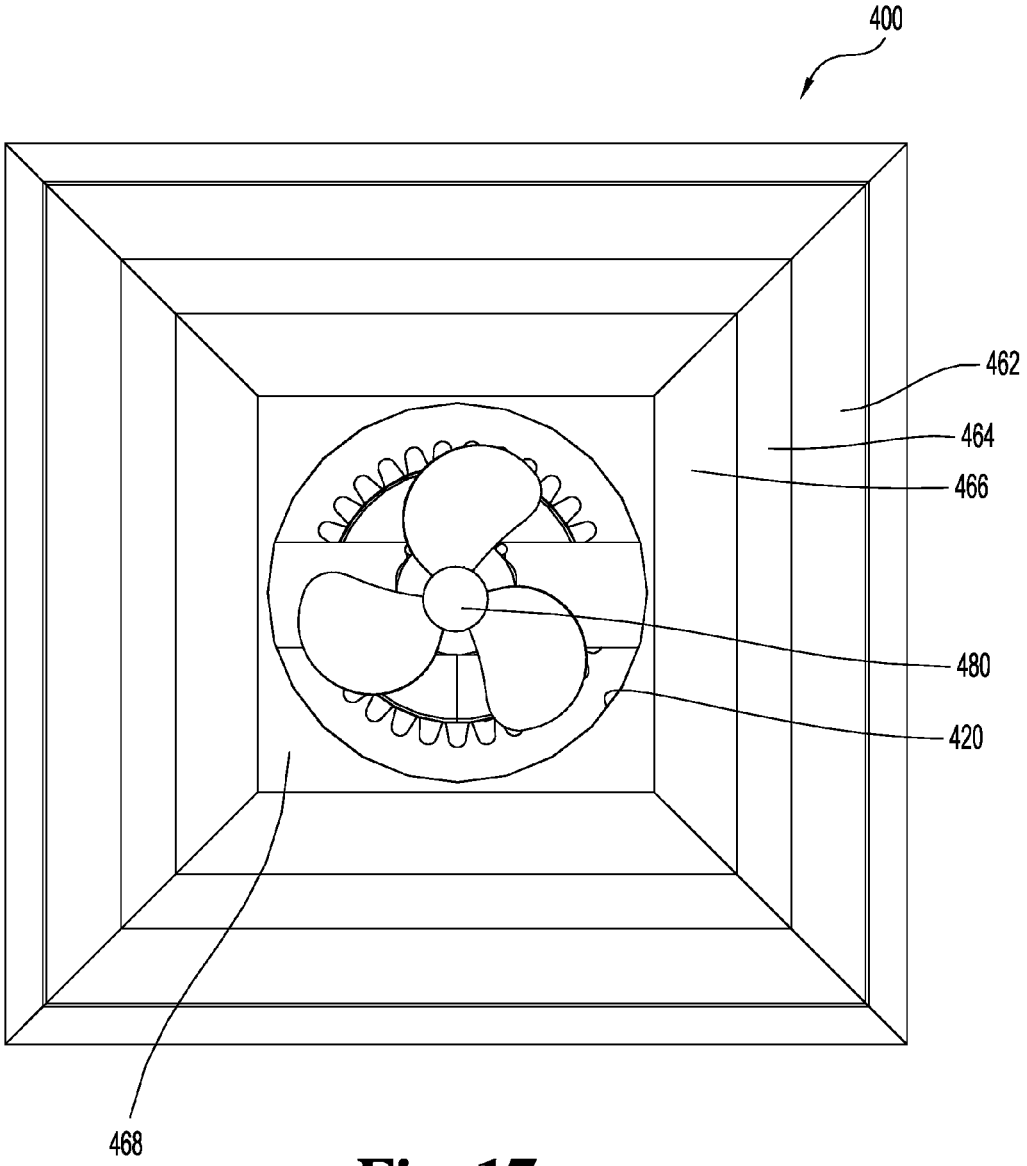
FIG. 17 illustrates a bottom plan view of the FIG. 13 dropped ceiling fan with the illustrated grid element removed.

As best seen in FIGS. 14-16, outer body element 410 includes opening 422 surrounded by mounting flange 492 on top surface 412. Mounting flange 492 may be constructed and arranged to be connected to HVAC ductwork. Mounting flange 492 may be circular, as illustrated, or may be any other shape or size to be connected to any desired ductwork or other structure. As shown in FIG. 16, mounting flange 492 may be connected to HVAC duct 98 to couple dropped ceiling fan 400 to an HVAC system (not illustrated). When coupled to HVAC duct 98, ceiling fan 400 may operate in part as a HVAC register that includes a booster fan to increase airflow through HVAC duct 98. This may be useful in connection with particularly long HVAC ducts and/or with HVAC ducts located in high demand areas, for example, building entry areas.

Dropped ceiling fan 400 also includes grid element 460, inclined elements 462, inclined elements 464, inclined elements 466 and plate 468 that defines opening 420. Plate 468 is generally centered in bottom 414. Inclined elements 462 extend downwardly and outwardly from the periphery of sides 416 defining outer body element 410. Inclined elements 464 extend downwardly and outwardly from plate 468. This can be seen in FIG. 17 that illustrates the bottom of ceiling fan 400 with grid 460 omitted. Grid 460 is supported below opening 420 with inclined elements 466 extending downwardly and outwardly from the periphery of grid 460.

Inclined elements 462 and 464 cooperate to define inlet 463 that is constructed and arranged to collect air from the periphery area of the dropped ceiling fan near the ceiling. Inclined elements 464 and 466 cooperate to define outlet 465 that is constructed and arranged to direct expelled air outwardly and downwardly from dropped ceiling fan 400. Inlet 463 and outlet 465 are located between plate 468 and sides 416. Inclined elements 464 are coupled to plate 468 and define a barrier between inlet 463 and outlet 465 that is best seen in FIG. 16.

Grid 460 comprises a plurality of vertically oriented elements positioned below opening 420 that are constructed and arranged to direct expelled air downwardly from dropped ceiling fan 400.

While not illustrated, elements 466 and 464 are coupled to element 462 by small extension rods positioned in the corners of the elements. Element 462 is coupled to body element 210. Grid 460 is attached to inclined elements 466.

Dropped ceiling fan 400 is configured to draw air both from the room below through inlet 463 and from duct 98 through opening 422. Dropped ceiling fan 400 is configured to then expel the air into the room below through grid 460 and outlet 465 (when fluid impelling device 480 operates).

In one embodiment, dropped ceiling fan 400 draws approximately half the inlet air from the room below and the other half from duct 98 when the attached HVAC system is operating. During time in which the HVAC system is not forcing air through duct 98 (with a separate fan or blower), dropped ceiling fan 400 may be operated to mix air in an area by drawing inlet air from the room below to re-circulate that air in the room below.

This disclosure serves to illustrate and describe what is claimed below to aid in the interpretation of the claims. However, this disclosure is not restrictive in character because not every embodiment covered by the claims is necessarily illustrated and described. All changes and modifications that come within the scope of the claims are desired to be protected, not just those embodiments explicitly described.

We claim:

1. A dropped ceiling fan for use in a room, the dropped ceiling fan comprising:

an elongated body element having an upper end and a lower end with a top surface at said top end, said elongated body element defining a vertical axis, wherein said top surface defines a non-ducted opening that does not include a mounting structure for coupling HVAC ductwork to said elongated body and wherein said elongated body element is constructed and arranged to be suspended in a dropped ceiling;

a fluid impelling device positioned inside said elongated body element, wherein said fluid impelling device is constructed and arranged to move air downwardly in said elongated body toward said lower end;

a plate defining a hole proximate to the middle of said plate, wherein said plate is disposed within said elongated body perpendicular to said vertical axis with the hole positioned below said fluid impelling device such that air moved downwardly by said fluid impelling device passes through the hole;

a peripheral intake opening surrounding said plate in the lower end of said elongated body element;

a first plurality of inclined elements in the peripheral intake opening constructed and arranged to direct air located adjacent to the lower end of said elongated body element into said elongated body element when said fluid impelling device moves air downwardly; and wherein said opening in said top surface is sized relative to said fluid impelling device such that, when said fluid impelling device moves air downwardly, a significant portion of the air that is moved downward by said fluid impelling device passes through said opening in said top surface from above the dropped ceiling and around said elongated body, wherein the fluid impelling device also draws air from the room below the dropped ceiling through said peripheral intake opening.

2. The dropped ceiling fan of claim 1, further comprising a filter positioned to cover said opening in said top surface, wherein said filter is constructed and arranged to filter substantially all air passing through said opening in said top surface.

3. The dropped ceiling fan of claim 2, wherein a portion of air moved downwardly by said fluid impelling device is filtered by said filter before entering said elongated body and a remaining portion of air moved downwardly by said fluid impelling device is not filtered by said filter before entering said elongated body.

4. The dropped ceiling fan of claim 1, further comprising a plurality of vertically oriented elements positioned below the hole in said plate opening constructed and arranged to direct air moved by said fluid impelling device downwardly.

5. The dropped ceiling fan of claim 1, further comprising a grid work of vertically oriented elements positioned below the hole in said plate opening constructed and arranged to direct air moved by said fluid impelling device downwardly.

6. The dropped ceiling fan of claim 5, further comprising a second plurality of inclined elements positioned below and on the periphery of the hole in said plate that are constructed and arranged to direct the air moved by said fluid impelling device both outwardly and downwardly.

7. The dropped ceiling fan of claim 1, further comprising a second plurality of inclined elements positioned below and on the periphery of the hole in said plate that are constructed and arranged to direct the air moved by said fluid impelling device both outwardly and downwardly.

8. The dropped ceiling fan of claim 1, wherein said fluid impelling device is generally aligned with the vertical axis of said elongated body.

9. A dropped ceiling fan for use in a room, the dropped ceiling fan comprising:

an outer body element comprising a first top, a first left side, a first right side, a first front side, a first back side and a first bottom, wherein the first top, the first left side, the first right side, the first front side and the first back side are fluid impenetrable, wherein the outer body element defines a first cavity, wherein the first bottom defines a first opening accessing the first cavity and wherein the outer body element is constructed and arranged to be suspended in a dropped ceiling;

an inner body element comprising a second top, a second left side, a second right side, a second front side, a second back side and a second bottom, wherein the second left side, the second right side, the second front side and the second back side are fluid impenetrable, wherein the inner body element defines a second cavity, wherein the second top defines a second opening accessing the second cavity, wherein the second bottom defines a third opening accessing the second cavity, wherein the inner body element is suspended within the outer body element inside the first cavity and wherein the space between the inner body element and the outer body element proximate to the first bottom side defined a circumferential opening that surrounds the inner body element;

a fluid impelling device located within the inner body constructed and arranged to move air toward the second bottom from the second top, wherein air can be drawn around the inner body element to the second top through the circumferential opening; and a first filter positioned above the fluid impelling device is constructed and arranged to filter substantially all fluid passing through the second opening in the inner body element, wherein the fluid impelling device draws air from the room through the circumferential opening, through the first filter and expels the air back into the room through the third opening, and wherein the first top of said outer body element defines a fourth opening sized such that, when said fluid impelling device moves air toward the second bottom from the second top, a significant portion of that air flows from above the dropped ceiling and outside said elongated body through the fourth opening on its way to the second top and a significant portion of that air flows from the room below the dropped ceiling through the circumferential opening on its way to the second top.

10. The dropped ceiling fan of claim 9, wherein the filter is rated MERF 14.

11. The dropped ceiling fan of claim 9, further comprising a second filter constructed and arranged to filter substantially all air passing through the fourth opening.

12. The dropped ceiling fan of claim 9, wherein the second filter is rated MERF 14.

13. The dropped ceiling fan of claim 9, wherein the dropped ceiling fan is constructed and arranged to draw approximately half the expelled air from the room below through the circumferential opening and the other half from the space above the dropped ceiling from through the fourth opening.

14. The dropped ceiling fan of claim 9, further comprising a plurality of vertically oriented elements positioned in the third opening constructed and arranged to direct the expelled air downwardly.

15. The dropped ceiling fan of claim 9, further comprising a first plurality of inclined elements positioned on the periphery of the third opening constructed and arranged to direct the expelled air outwardly and downwardly.

16. The dropped ceiling fan of claim 15, further comprising a second plurality of inclined elements positioned on the periphery of the first opening between the outer body element and the inner body element constructed and arranged to collect air from the periphery of the dropped ceiling fan.

17. The dropped ceiling fan of claim 9, further comprising a second plurality of inclined elements positioned on the periphery of the first opening between the outer body element and the inner body element constructed and arranged to collect air from the periphery of the dropped ceiling fan.

* * * * *